US007458363B2

(12) United States Patent
Blank

(10) Patent No.: US 7,458,363 B2
(45) Date of Patent: Dec. 2, 2008

(54) LOCKING CLAW

(75) Inventor: Kurt Blank, Ebersbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/790,340

(22) Filed: Apr. 25, 2007

(65) Prior Publication Data

US 2007/0251504 A1 Nov. 1, 2007

(30) Foreign Application Priority Data

Apr. 26, 2006 (DE) ..... 10 2006 019 306

(51) Int. Cl.
*F02M 61/14* (2006.01)

(52) U.S. Cl. ..... 123/470

(58) Field of Classification Search ..... 123/470, 123/456, 509, 468, 469
See application file for complete search history.

(56) References Cited

U.S. PATENT DOCUMENTS 4,133,321 A * 1/1979 Hofmann et al. ..... 123/470
4,901,700 A * 2/1990 Knight et al. ..... 123/470
5,121,731 A * 6/1992 Jones ..... 123/470
5,140,963 A * 8/1992 Brackett et al. ..... 123/470
5,706,786 A * 1/1998 Stephanus et al. ..... 123/470
6,283,772 B1 * 9/2001 Braun et al. ..... 439/100
7,334,571 B1 * 2/2008 Beardmore ..... 123/470
7,347,189 B2 * 3/2008 Anello et al. ..... 123/470
2003/0154960 A1 * 8/2003 Krome et al. ..... 123/470
2003/0154961 A1 * 8/2003 Liskow ..... 123/470

* cited by examiner

*Primary Examiner*—Thomas N Moulis
(74) *Attorney, Agent, or Firm*—Ronald E. Greigg

(57) ABSTRACT

The invention relates to a fastening device for fastening a fuel injector in the cylinder head region of an internal combustion engine. The fuel injector includes an injector body and is embodied substantially symmetrically to its primary injector axis. The fastening device is preferably embodied as a locking claw, on whose inner edge, surrounding the injector body, at least one detent lug fitting over the injector body is embodied.

12 Claims, 3 Drawing Sheets

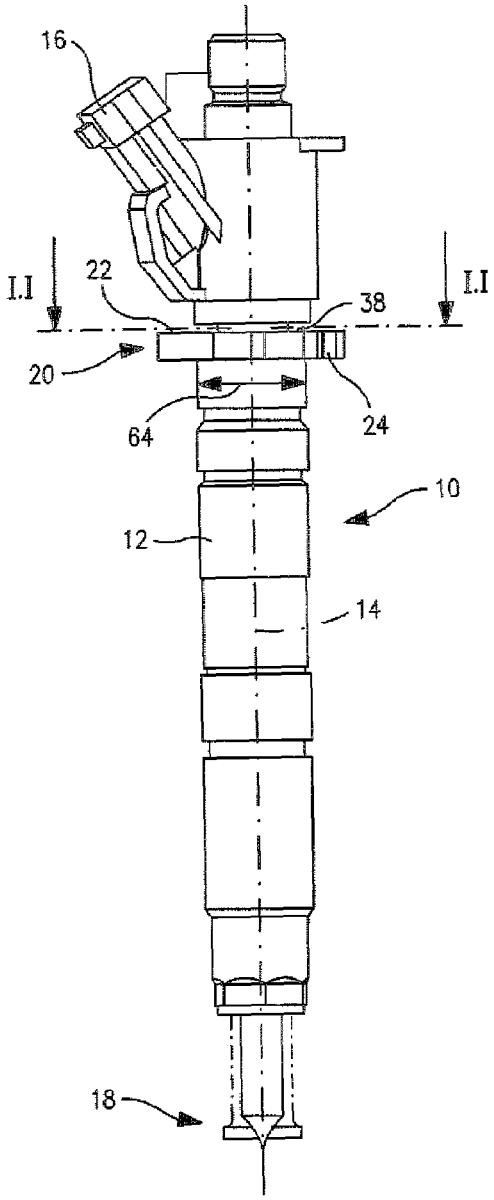
FIG. 1
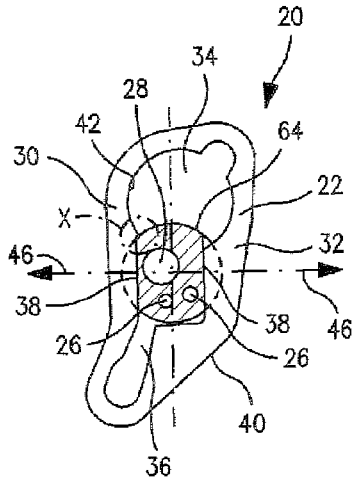
FIG. 1.1
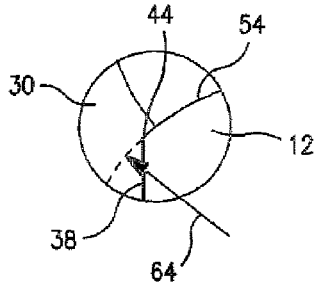
Detail X

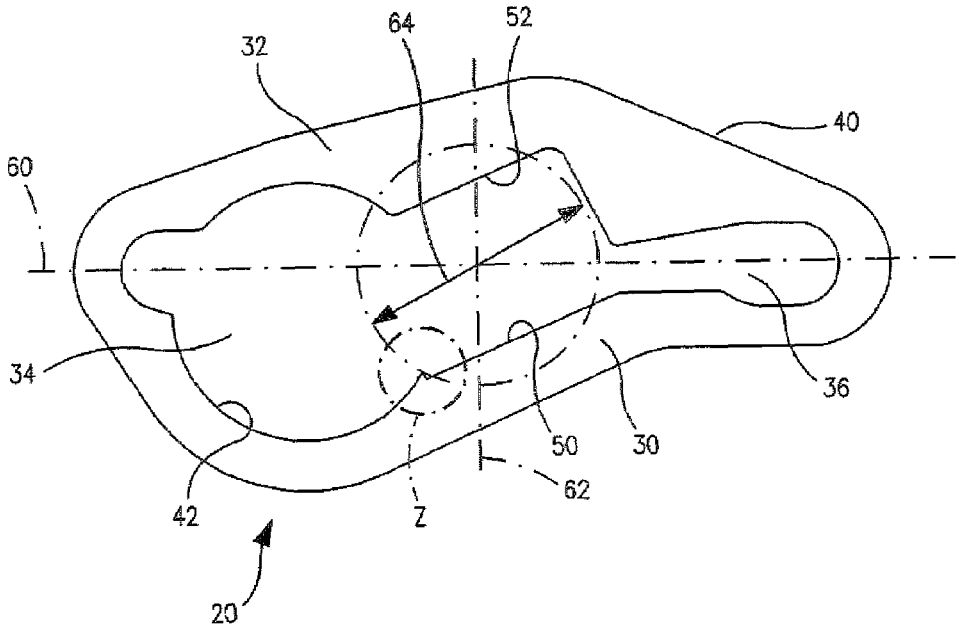
FIG. 4
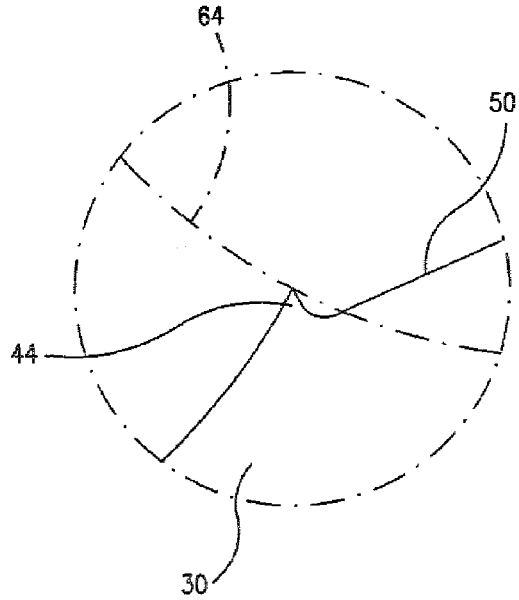
Detail Z

LOCKING CLAW

REFERENCE TO FOREIGN PATENT APPLICATION

This application is based on German Patent Application No. 10 2006 019 306.7 filed 26 Apr. 2006, upon which priority is claimed.

BACKGROUND OF THE INVENTION

1. Field of the Invention

This invention relates to an improved locking claw for securing a fuel injector to the engine block of an internal combustion engine.

2. Description of the Prior Art

Fuel injectors, which are used for instance in a high-pressure fuel injection system (common rail) in internal combustion engines, are generally secured to the cylinder block of the engine with claws. The generally slender fuel injector is secured against jarring, which is very much the rule when a motor vehicle is being driven, by the claws. The claws for fastening the fuel injectors to the cylinder block of internal combustion engines can be furnished either as a separate component and secured to the fuel injector or secured to the injector body of the fuel injector by means of an additional component, such as one or more plastic clips. In claws known up to now for securing fuel injectors to internal combustion engines, plastic clips that are used require one additional production step in the assembly of the engine, and furthermore additional small parts have to be kept on hand.

OBJECT AND SUMMARY OF THE INVENTION

According to the invention, a locking claw is proposed which can be sold already secured to the injector body of the fuel injector. No additional part, such as the plastic clip needed in the prior art, is needed for securing the locking claw proposed according to the invention. Between two resiliently embodied cheeks, the locking claw includes one recess, preferably in the nature of a rounded opening, and another, slotlike recess diametrically opposite it. Between these two recesses, defined essentially by the cheeks of the locking claw, there are bearing faces. On the outer circumference, these bearing faces serve to receive a fuel injector, in particular the injector body of the fuel injector, at which the fuel injector has a flat face. The flat face on the injector body is preferably embodied as a double flat face, so that two diametrically opposed faces extending parallel to one another are created.

The locking claw proposed according to the invention may be widened, for instance by means of a tool that is thrust into the recess, preferably made as a rounded opening, for instance, of the locking claw, so that the elastically embodied cheeks of the locking claw are moved apart, and the locking claw can simply be clipped into the receptacle embodied on the circumference of the injector body.

With regard to the diameter of the injector body, the receptacle embodied on the circumference of the injector body is embodied so that the locking claw, in the state in which it is locked to the injector body, is resiliently secured against shifting in the axial direction relative to the injector body.

On an open end of either the slotlike opening of the locking claw or on the open end of the rounded opening of the locking claw, a protrusion can be embodied that acts as a detent lug. This detent lug, which is a raised protrusion protruding past the inner edge of one of the cheeks of the locking claw, can be embodied in stamped, lasered or embossed fashion. The assembly of the fuel injector is done by inserting the injector body through the opening, preferably in the nature of a rounded portion, of the locking claw and radially pushing the locking claw on into the receptacle region, that is, the region of the injector body on which a flat face in the form of a double flat face is preferably embodied. Once the locking claw is installed, it is received in captive fashion on the circumference of the injector body of the fuel injector. Since the locking claw is received releasably and with tolerance on the circumference of the injector body, the locking claw can compensate for additional tolerances occurring in the process of its being secured on the cylinder head of the engine.

Preferably, on being joined to the injector body of the fuel injector, the locking claw is spread apart by means of a spreader. This spreader may either be introduced into the preferably rounded opening of the locking claw and then widened, or placed in a preferably slotlike recess of the locking claw and then widened. Depending on the diameter of the preferably rounded opening in the locking claw, or the length of the recess formed as a slit in the locking claw, the spring properties of the cheeks of the locking claw can be predetermined. Because of the elasticity of the material from which the locking claw is made, contact of bearing faces, embodied as straight edges, on the inner edge of the locking claw with the flat face, embodied complementary to them, on the injector body is assured, and the flat face on the injector body is preferably embodied as a double flat face.

BRIEF DESCRIPTION OF THE DRAWINGS

The invention will be better understood and further objects and advantages thereof will become more apparent from the ensuing detailed description of preferred embodiments taken in conjunction with the drawings, in which:

FIG. 1 is an elevation view of a fuel injector with a locking claw mounted on it;

FIG. 1.1 is a section through the injector body above the locking claw, along the section line I.I-I.I. shown in FIG. 1;

Figure 2:
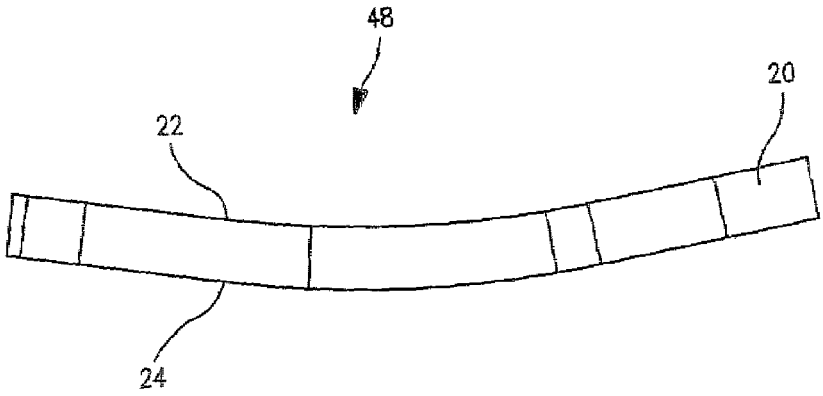
Figure 3:
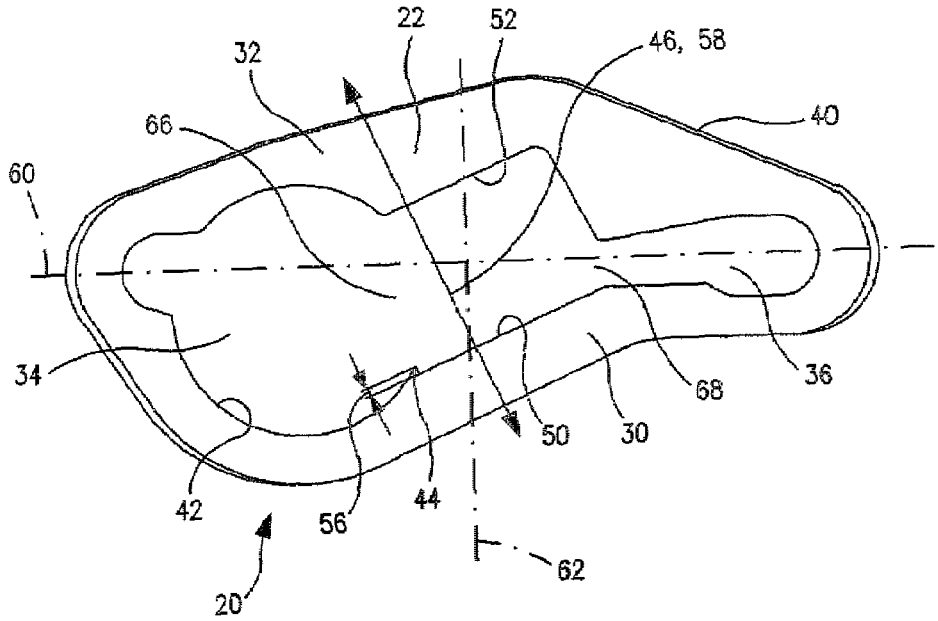

Detail X is a detail of the inner edge of the locking claw, with the detent lug that fixed the injector body;

FIG. 2 is a side view of the locking claw;

FIG. 3 is a top view of the locking claw with its internal contours and axes shown;

FIG. 4 is a top view of the locking claw similar to the view in FIG. 3; and Detail Z is an enlarged view of a detent lug embodied on one of the cheeks of the locking claw.

DESCRIPTION OF THE PREFERRED EMBODIMENTS

The view in FIG. 1 shows a fuel injector 10 on whose injector body 12 a fastening device embodied according to the invention, in the form of a locking claw 20, is received. The fuel injector 10 is embodied substantially symmetrically to a primary injector axis 14 and includes an electrical terminal 16 that is mounted laterally on the injector body 12. In use, the fuel injector 10 shown in FIG. 1 is disposed in the cylinder head region of an internal combustion engine and is secured to the engine via the fastening device 20 embodied preferably as a locking claw. The end toward the combustion chamber from which the fuel under high pressure is injected into the combustion chamber of the engine (not shown in FIG. 1) is represented by reference numeral 18. The slender fuel injector 10 is introduced by the end 18 toward the combustion chamber into an opening intended for it in the cylinder head region of the engine.

The injector body 12 is embodied substantially cylindrically, with a diameter 64. In the view shown in FIG. 1, there is a recess on the injector body 12, preferably embodied as a flat face and more preferably as a double flat face. The term double flat face will be understood hereinafter to mean a configuration of the flat face that has at least two faces extending substantially parallel to one another. The recess has two flat faces 38 in the view in FIG. 1.1, which are embodied symmetrically with regard to the diameter 64 of the injector body 12 of the fuel injector 10. The fastening device 20 proposed according to the invention, which has an upper face end 22 and a lower face end 24, is fitted into the recess against the flat face 38 on the circumference of the injector body 12.

In the view in FIG. 1, a section line through the injector body 12 is indicated by the course marked I.I-I.I, which extends above the upper face end 22 of the fastening device 20.

FIG. 1.1 shows the section line I.I-I.I through the injector body 12 as shown in FIG. 1.

It can be seen from the view in FIG. 1.1 that the fastening device 20 has an opening including a first opening part 34 and a second opening part 36. While the first opening part 34 is preferably embodied in circular form, the second opening part 36 is preferably shaped like a slot. The first opening part 34 and the second opening part 36 are defined by an inner edge 42 of the fastening device 20. From the view in FIG. 1.1, it can be seen that the fastening device 20 has at least one resiliently embodied first cheek 30 and preferably a further, also resilient second cheek 32. The first cheek 30 and the second cheek 32 extend substantially parallel to one another, and between them, as shown in FIG. 1.1, the injector body 12 of the fuel injector 10 is received. The first cheek 30 and the second cheek 32 rest with their inner edge 42 on the faces of recess 38 on the circumference of the injector body 12 of the fuel injector 10 along the section I.I-I.I in FIG. 1.

An outer edge of the fastening device 20 is identified by reference numeral 40. Detail X is the region in which, on the inner edge 42 of the fastening device 20 a luglike protrusion 44 is embodied, which will be described in further detail hereinafter.

A resilient motion of the first cheek 30 and second cheek 32 of the fastening device 20 is indicated in the view in FIG. 1.1 by the arrows 46.

The injector body 12 is thrust through the first opening portion 34, which preferably has a slightly larger diameter than the diameter 64 of the injector body 12. The fastening device 20 is thrust over the circumference of the injector body 12 and in the region of the flat face 38 on the circumference of the injector body 12, it is thrust laterally into the flat face 38. In this position, the locking claw rests in the flat face 38, preferably embodied as a double flat face, in the region of the inner edge 42 of the first cheek 30 and of the second cheek 32, and is received in captive fashion on the circumference of the injector body 12 of the fuel injector 10.

It can be seen from detail X that a detent lug 44 is embodied in the region of the first cheek 30. The detent lug 44 can be stamped into the fastening device 20 or embossed on the inner edge 42, or made in the course of the laser pricking. It can also be seen from detail X that the detent lug 44 on the first cheek 30 is made in the transition region from the flat face 38 of the injector body 12 to a rounded portion 54 of the injector body 12. The diameter 64 of the injector body 12 corresponds to the diameter of the rounded portion 54. By means of the detent lug 44, the injector body 12 is fixed in captive fashion in the transition region, shown in detail X, between the flat face 38 and the rounded portion 54. The protrusion embodied on the first cheek 30 and forming the detent lug 44 is embodied at a height of a few tenths of a millimeter and makes captive fixation of the fastening device 20 possible on the flat face 38 of the injector body 12 that is preferably embodied as a double flat face.

FIG. 2 shows a side view of the fastening device 20 which is preferably embodied as a rolled component. A characteristic of this embodiment is the fact that because of the rolling, the fastening device 20 assumes the curvature 48 shown in FIG. 2 on both its upper face end 22 and its lower face end 24. Because of the convex or concave face ends 22, 24 of the fastening device 20 an initial tension of the fastening device 20 in the installed state in the flat face 38 on the injector body 12 is achieved. This enhances the security against loss, since the curvature 48 of the face ends 22, 24 brings about a prestressing force between the faces of the injector body 12 that axially define the flat face 38 on the injector body 12. The fastening device 20 may also be embodied as a sintered component or as a fine cast component.

It can be seen from the view in FIG. 3 that the fastening device 20 has a first axis 60 and a second axis 62; the second axis 62 extends perpendicular to the first axis 60 of the fastening device 20. A first bearing face 50 and a second bearing face 52 are embodied on the first cheek 30 and on the second cheek 32, diametrically opposite it, respectively. The bearing faces 50 and 52 shown in FIG. 3 represent the regions of the inner edge 42 of the fastening device 20 with which the fastening device is locked in the flat face 38 on the injector body 12. After being slipped laterally into the flat face 38 on the injector body 12, the at least one detent lug 44, protruding in raised fashion by an excess 56 past the inner edge 42 fits around the injector body 12, as shown on a larger scale in detail X in conjunction with FIG. 1.1.

It can also be seen from FIG. 3 that a widening 58 can be performed because of the elasticity of the first cheek 30 and the second cheek 32, by introducing a spreading tool into the preferably circular first opening portion 34 of the fastening device 20. By widening the inner edge 42, which is easily possible because of the intrinsic elasticity of the first cheek 30 and the second cheek 32, scratching of the jacket face of the injector body 12 of the fuel injector 10 can be avoided. It can also be seen from the view in FIG. 3 that an open end 66 of the first opening portion 34 and an open end 68 of the preferably slotlike second opening portion 36 are diametrically opposite one another. Depending on the width of the open ends 66 and 68, and the length of the preferably slotlike second opening 36, the elasticity of the first cheek 30 and of the second cheek 32 can be adjusted. Thus various prestressing forces can be provided for, depending on the application. Because of the resilient embodiment of the fastening device 20 tolerances in securing the fuel injector in the cylinder head region of an internal combustion engine, whether it is a self-igniting or externally ignited engine, can be compensated for.

From the view in FIG. 4, it can be seen that the fastening device 20 surrounds the injector body 12 above the diameter 64 shown in FIG. 4. The fastening device 20 rests with the first bearing face 50 of the first cheek 30 and the second bearing face 52 of the second cheek 32 in the flat face 38 of the injector body 12, and this flat face 38 is preferably embodied as a double flat face. For the sake of greater simplicity, the view in FIG. 4 does not show the injector body 12, which is instead merely represented by its diameter 64. Detail Z shows the at least one detent lug 44, embodied on the first cheek 30 at the end of the first bearing face 50 on the first cheek 30. The detent lug is embodied such that it fits over the circumference of the injector body 12 at the transition point from the flat face 38—see FIG. 1.1—to the rounded portion 54 of the injector body (see also detail X).

The foregoing relates to preferred exemplary embodiments of the invention, it being understood that other variants and embodiments thereof are possible within the spirit and scope of the invention, the latter being defined by the appended claims.

I claim:

1. A fastening device for a fuel injector in the cylinder head region of an internal combustion engine, in which the fuel injector includes an injector body and is embodied essentially symmetrically to a primary injector axis, the fastening device being embodied as a locking claw, the locking claw having an opening therethrough fitting over the injector body, and at least one detent lug on inner edge of said opening, wherein the detent lug is embodied as a raised protrusion protruding vast the inner edge of the opening.

2. The fastening device as defined by claim 1, the locking claw comprising at least one resiliently embodied cheek.

3. The fastening device as defined by claim 1, the locking claw comprising at least one bearing face embodied on said inner edge.

4. A fastening device for a fuel injector in the cylinder head region of an internal combustion engine, in which the fuel injector includes an injector body and is embodied essentially symmetrically to a primary injector axis, the fastening device being embodied as a locking claw, the locking claw having an opening therethrough fitting over the injector body, and at least one detent lug on an inner edge of said opening, wherein the detent lug is embodied as a raised protrusion protruding past the inner edge of the opening, wherein said opening comprises a first opening portion and a second opening portion, the first opening portion being embodied with a diameter which exceeds a diameter of the injector body, and the second opening portion preferably being embodied in slotlike form.

5. In combination, a fuel injector for an internal combustion engine and a fastening device for fastening the fuel injector in the cylinder head region of the engine, the fuel injector comprising an injector body embodied essentially symmetrically to a primary longitudinal axis, and at least one flat face, and the fastening device comprising a locking claw having an opening therethrough fitting over the injector body, and at least one detent lug on an inner edge of said opening, wherein the detent lug is embodied as a raised protrusion protruding past the inner edge of the opening.

6. The fastening device as defined by claim 5, comprising at least one resiliently embodied cheek, and at least one bearing face embodied on the inner edge of the at least one cheek and adapted to rest on the at least one flat face on the injector body.

7. In combination, a fuel injector for an internal combustion engine and a fastening device for fastening the fuel injector in the cylinder head region of the engine, the fuel injector comprising an injector body embodied essentially symmetrically to a primary longitudinal axis, and at least one flat face, and the fastening device comprising a locking claw having an opening therethrough fitting over the injector body. and at least one detent lug on an inner edge of said opening, wherein the detent lug is embodied as a raised protrusion protruding past the inner edge of the opening, wherein the at least one detent lug fits over the injector body at the transition from at least one the flat face to a rounded portion.

8. A fastening device for a fuel injector in the cylinder head region of an internal combustion engine, in which the fuel injector includes an injector body and is embodied essentially symmetrically to a primary injector axis, the fastening device being embodied as a locking claw, the locking claw having an opening therethrough fitting over the injector body, and at least one detent lug on an inner edge of said opening, wherein the detent lug is embodied as a raised protrusion protruding past the inner edge of the opening, wherein the fastening device is embodied as a rolled component and is manufactured as a component that on at least one of its face ends has a curvature.

9. The fastening device as defined by claim 4, further comprising at least one resiliently embodied cheek, and at least one bearing face embodied on the inner edge of the at least one cheek and adapted to rest on the at least one flat face on the injector body, and wherein the first opening portion and the second opening portions each have open ends, which open ends point toward the at least one bearing face embodied on the at least one cheek.

10. The fastening device as defined by claim 1, wherein the at least one detent lug is stamped into the inner edge, embossed on the inner edge, or generated on the inner edge by laser forming.

11. The fastening device as defined by claim 6, wherein the at least one flat face on the injector body is embodied as a double flat face.

12. The fastening device as defined by claim 9, wherein the at least one flat face on the injector body is embodied as a double flat face.

* * * * *